US009486056B2

(12) United States Patent
Lee

(10) Patent No.: US 9,486,056 B2
(45) Date of Patent: Nov. 8, 2016

(54) COSMETIC CONTAINER CAPABLE OF STORING AND DISCHARGING TWO KINDS OF CONTENTS

(71) Applicant: PUM-TECH KOREA CO., LTD, Incheon (KR)
(72) Inventor: Do Hoon Lee, Incheon (KR)
(73) Assignee: Pum-Tech Korea Co., LTD, Bupyeong-gu, Incheon (KR)

( * ) Notice: Subject to any disclaimer, the term of this patent is extended or adjusted under 35 U.S.C. 154(b) by 0 days.
(21) Appl. No.: 14/890,417
(22) PCT Filed: Mar. 25, 2014
(86) PCT No.: PCT/KR2014/002478
§ 371 (c)(1),
(2) Date: Nov. 10, 2015
(87) PCT Pub. No.: WO2014/163315
PCT Pub. Date: Oct. 9, 2014
(65) Prior Publication Data
US 2016/0206079 A1 Jul. 21, 2016
(30) Foreign Application Priority Data
Apr. 1, 2013 (KR) ..... 20-2013-0002395 U
(51) Int. Cl.
*B67D 7/70* (2010.01)
(Continued)
(52) U.S. Cl.
CPC ..... *A45D 40/24* (2013.01); *A45D 34/00* (2013.01); *A45D 34/06* (2013.01);
(Continued)
(58) Field of Classification Search
CPC .. A45D 40/24; A45D 34/00; B05B 11/3015; B05B 11/2023
USPC ..... 222/137, 135, 145.6; 401/44–47, 188 R; 206/219; 132/299
See application file for complete search history.

(56) References Cited

U.S. PATENT DOCUMENTS 4,674,659 A * 6/1987 Micallef ..... B05B 11/3001 222/148
(Continued)

FOREIGN PATENT DOCUMENTS

KR 20-0442446 Y1 11/2008
(Continued)

*Primary Examiner* — Patrick M Buechner
*Assistant Examiner* — Jeremy W Carroll
(74) *Attorney, Agent, or Firm* — East West Law Group; Heedong Chae

(57) ABSTRACT

The present invention relates to a cosmetic container capable of storing and discharging two kinds of contents, and more particularly to a cosmetic container capable of storing and discharging two kinds of contents, in which one cosmetic content can be used or two kinds of cosmetic contents are simultaneously discharged, mixed, and used by selectively discharging cosmetic contents stored in two storage containers provided inside a cosmetic container body, an upper portion of a content discharge housing is recessed in a dish shape so that the cosmetic contents are discharged into an inner lateral side of the dish-shaped upper portion of the cosmetic container and gathered to the recessed center when the cosmetic contents are discharged after the upper portion of the cosmetic container is recessed in the dish shape, and an outlet is closed with an opening/closing protrusion after the cosmetic contents are discharged to prevent the cosmetic contents remaining in the outlet from being solidified or hardened. The cosmetic container includes first and second storage containers ($V_1$ and $V_2$) to receive cosmetic contents, pistons (P) provided in openings of the first and second storage containers ($V_1$ and $V_2$) to discharge the cosmetic contents, a container body (10) coupled to a lower cap (C) to receive the first and second storage containers ($V_1$ and $V_2$), a content discharging housing (120) coupled to an upper portion of the container body (110) and formed therein with a button receiving groove (124) to receive a side button (121), the side button (121) received in the button receiving groove (124) of the content discharging housing (120) to move back and forth, and a content discharge piston (123) descending down as the side button (121) is pressed, and ascending as the pressing of the side button (121) is released. The container body (110) is provided at an upper portion thereof with a piston receiving groove (112), lower guides (111) are formed at left and right sides of the piston receiving groove (112) to guide the side button (121) to move back and forth, the content discharging housing (120) is formed therein with a discharge piston receiving groove (125) to receive the content discharge piston (123) and formed at an upper portion thereof with an arc surface (127) having a dish shape, such that an upper most portion of the discharge piston receiving groove (125) and a side of the arc surface (127) are bored to form an outlet (126) to discharge the cosmetic contents, and the content discharge piston (123) is formed at a center thereof with a discharge hole (123*a*) to discharge the cosmetic contents, and formed at an upper end portions thereof with an opening/closing protrusion (123*b*).

7 Claims, 8 Drawing Sheets

(51) Int. Cl.

| | |
|---|---|
| ***A45D 40/24*** | (2006.01) |
| ***A45D 34/06*** | (2006.01) |
| ***A45D 34/00*** | (2006.01) |
| ***B65D 81/32*** | (2006.01) |
| ***B65D 83/00*** | (2006.01) |
| *B05B 11/00* | (2006.01) |

(52) U.S. Cl.
CPC ..... *B05B 11/3015* (2013.01); *B05B 11/3023* (2013.01); *B05B 11/3052* (2013.01); *B05B 11/3084* (2013.01); *B65D 81/325* (2013.01); *B65D 83/0033* (2013.01); *B05B 11/0048* (2013.01); *B05B 11/3025* (2013.01)

(56) References Cited

U.S. PATENT DOCUMENTS

| | | | | |
|---|---|---|---|---|
| 2011/0315574 | A1* | 12/2011 | Lee | A45D 34/00 206/219 |
| 2012/0267391 | A1* | 10/2012 | Yoo | A45D 34/00 222/41 |
| 2013/0056494 | A1* | 3/2013 | Pires | G01F 11/021 222/137 |

FOREIGN PATENT DOCUMENTS

| | | | |
|---|---|---|---|
| KR | 10-2010-0102014 | A | 9/2010 |
| KR | 10-1182225 | B1 | 9/2012 |
| KR | 10-2012-0120884 | A | 11/2012 |

* cited by examiner

COSMETIC CONTAINER CAPABLE OF STORING AND DISCHARGING TWO KINDS OF CONTENTS

TECHNICAL FIELD

The present invention relates to a cosmetic container capable of storing and discharging two kinds of contents, and more particularly to a cosmetic container capable of storing and discharging two kinds of contents, in which one cosmetic content can be used or two kinds of cosmetic contents can be simultaneously discharged, mixed, and used by selectively discharging cosmetic contents stored in two storage containers provided inside a cosmetic container body, an upper portion of a content discharge housing is recessed in a dish shape so that the cosmetic contents are discharged into an inner lateral side of the dish-shaped upper portion of the cosmetic container and gathered to the recessed center when the cosmetic contents are discharged after the upper portion of the cosmetic container is recessed in the dish shape, and an outlet is closed by an opening/closing protrusion after the cosmetic contents are discharged to prevent the cosmetic contents remaining in the outlet from being solidified or hardened.

BACKGROUND ART

In the case of liquid-type cosmetics, such as lotions, creams, gels, shampoos, and conditioners, or gel-type cosmetics having low viscosity, an airless pump is received in a cosmetic container and used to easily spout the contents.

A cosmetic container to receive the cosmetics having the coefficient of viscosity is designed so that the contents received in the cosmetic container are discharged in a small amount. In particular, the the cosmetic container is mainly used for functional cosmetics.

In addition, the airless pump applied to a cosmetic container is used for a heterogeneous content mixing cosmetic container which mixes and discharges two kinds of contents having mutually different ingredients. In other words, as one type of functional cosmetics, there is a product for improving the effects thereof when contents having mutually different ingredients are mixed and used, and the airless pump is mounted in the functional cosmetic container to discharge contents.

A heterogeneous content mixing cosmetic container according to the related art is disclosed in Korean Unexamined Utility Model Publication No. 2008-0002044 (published on Jun. 23, 2008). FIGS. 1 and 2 show a heterogeneous contents mixing cosmetic container which mixes and discharges two kinds of contents having mutually different ingredients according to the related art. As shown in FIGS. 1 and 2, a heterogeneous content mixing cosmetic container 10 according to the related art includes a container body 11, airless pumps 12*a* and 12*b*, pistons 13*a* and 13*b*, and a pressing button.

As described above, the internal space of the container body 11 is partitioned into two receiving parts 11*b* and 11*c* by a separator, and two kinds of contents having mutually different ingredients are filled in the two receiving parts 11*b* and 11*c*. The airless pumps 12*a* and 12*b* are mounted at the upper portions of the two receiving parts 11*a* and 11*b*.

The pistons 13*a* and 13*b* are mounted in the two receiving parts 11*a* and 11*b* of the container body 11, respectively. The pistons 13*a* and 13*b* ascends in cooperation with the airless pumps 12*a* and 12*b*, and the ascending the pistons 13*a* and 13*b* push up the contents in the receiving parts 11*a* and 11*b*.

The pressing button 14 is mounted at the upper portion of the airless pumps 12*a* and 12*b* to press the airless pumps 12*a* and 12*b*. Accordingly, a structure of discharging two contents from two receiving parts 11*a* and 11*b* of the container body 11 by the pressing button 14 is formed.

Hereinafter, the operation of the heterogeneous content mixing cosmetic container according to the related art having the configuration will be described with reference to FIG. 2. First, if the airless pumps 12*a* and 12*b* positioned at the receiving parts 11*a* and 11*b*, respectively, are pumped by pressing the pressing button 14, pressure is generated inside the pump cylinders 18*a* and 18*b* and passages to transfer the contents of piston rods 16*a* and 16*b* are ensured. Accordingly, the contents filled in the pump cylinders 18*a* and 18*b* are discharged through discharge holes 14*a* and 14*b* via drain tubes 15*a* and 15*b* of the pressing button 14.

If external force applied to the pressing button 14 is released after the contents have been discharged, the piston rods 16*a* and 15*b* to receive the repulsive force of the springs 17*a* and 17*b* ascend to original positions thereof. In this case, internal vacuum pressure of the pump cylinders 18*a* and 18*b* is generated while balls, which close introducing holes 19*a* and 19*b*, are separated from the introducing holes 19*a* and 19*b*, so that the contents in the receiving parts 11*a* and 11*b* are filled into the pump cylinders 18*a* and 18*b*.

The contents having mutually different ingredients and received in the two receiving parts 11*a* and 11*b* of the container body 11 are discharged to the outside for use through the above procedures.

However, in the heterogeneous content mixing cosmetic container according to the related art, the discharge hole is provided at the side of the pressing button. Accordingly, since the contents are discharged through the discharge hole of the moving pressing button during the actuating of the pressing button, the contents are frequently dropped to the floor. Accordingly, resources may be wasted and surrounding environments may be made in an unclean state. In addition, after discharging two contents, the two contents must be mixed using an additional mixing container. Further, since the contents remaining in the discharge hole are exposed to the outside after the contents have been discharged, the remaining contents are solidified or hardened to cause skin troubles when the user uses the contents thereafter.

In addition, according to the conventional cosmetic container, a user must hold the entire portion of the cosmetic container in a hand of the user, and press the pressing button positioned at the upper portion of the cosmetic container to discharge the cosmetic contents. Accordingly, a woman having a small hand may feel inconvenient when using the cosmetics.

DISCLOSURE

Technical Problem

The present invention is made while keeping in mind the above problems occurring in the related art, and an object of the present invention is to prevent cosmetic contents from being dropped to the floor differently from the related art to make a surrounding, where a user makes up, clean, and to prevent resources from being wasted due to the excessive unnecessary discharge of the contents since an amount of discharged contents can be detected, by discharging the contents to an inner side of an upper dish-shaped part of a cosmetic container and gathering the contents to the center of the dish-shaped part as the upper portion of the cosmetic container is recessed in the dish shape, when the cosmetic contents are discharged from a storage container provided in a body of the cosmetic container due to the action of the piston.

Another object of the present invention is to allow a user to mix two kinds of cosmetic contents discharged to the upper portion of a content discharging housing without an additional mixing container after the two kinds of cosmetic contents have been discharged, as the upper portion of the content discharging housing positioned at an upper portion of the cosmetic container is recessed in the dish shape.

Still another object of the present invention is to prevent cosmetic contents remaining in a discharge hole from being exposed to the outside to be solidified or hardened by closing the discharge hole by an opening/closing protrusion after the cosmetic contents have been discharged and used.

Still another object of the present invention is to provide a cosmetic container, capable of being easily used by a woman having a small hand by allowing the woman to press the side of the cosmetic container with the finger of the user, so that two kinds of contents are easily discharged upward of the cosmetic container.

Technical Solution

In order to accomplish the above objects, there is provided a cosmetic container for storing and discharging two kinds of cosmetic. The cosmetic container including first and second storage containers ($V_1$ and $V_2$) to receive cosmetic contents, pistons (P) provided in openings of the first and second storage containers ($V_1$ and $V_2$) to discharge the cosmetic contents, a container body (10) coupled to a lower cap (C) to receive the first and second storage containers ($V_1$ and $V_2$), a content discharging housing (120) coupled to an upper portion of the container body (110) and formed therein with a button receiving groove (124) to receive a side button (121), the side button (121) received in the button receiving groove (124) of the content discharging housing (120) to move back and forth, and a content discharge piston (123) descending down as the side button (121) is pressed, and ascending as the pressing of the side button (121) is released. The container body (110) is provided at an upper port ion thereof with a piston receiving groove (112), lower guides (111) are formed at left and right sides of the piston receiving groove (112) to guide the side button (121) to move back and forth, the content discharging housing (120) is formed therein with a discharge piston receiving groove (125) to receive the content discharge piston (123) and formed at an upper portion thereof with an arc surface (127) having a dish shape, such that an upper most portion of the discharge piston receiving groove (125) and a side of the arc surface (127) are bored to form an outlet (126) to discharge the cosmetic contents, and the content discharge piston (123) is formed at a center thereof with a discharge hole (123*a*) to discharge the cosmetic contents, and formed at an upper end portions thereof with an opening/closing protrusion (123*b*).

Advantageous Effects

As described above, according to the present invention, the upper portion of the content discharging housing is recessed in the dish shape while forming an arc shape, so that the discharged cosmetic contents can be gathered to one place. Accordingly, the cosmetic contents can be prevented from being dropped to the floor different from the related art. Accordingly, the surrounding, where the user makes up, is made clean. In addition, since the user can detect an amount of discharged cosmetic contents, resources can be prevented from being wasted due to the excessive unnecessary discharge of the cosmetic contents.

In addition, after the two kinds of cosmetic contents have been discharged, the user can use the two kinds of cosmetic contents by mixing the two kinds of the cosmetic contents at the arc surface recessed in the dish shape and provided at the upper portion of the content discharging housing without the additional mixing container.

In addition, after the cosmetic contents have discharged and used, the discharge hole of the content discharging housing is closed with the opening/closing protrusion to prevent the cosmetic contents remaining in the discharge hole from being solidified or contaminated by external air. In addition, according to the present invention, as the side button mounted on the side of the cosmetic container is pressed by the finger of the user, two kinds of contents can be easily discharged upward of the cosmetic container. Accordingly, the woman having the small hand can easily use the cosmetic container.

BEST MODE

[Mode for Invention]

Figure 1:
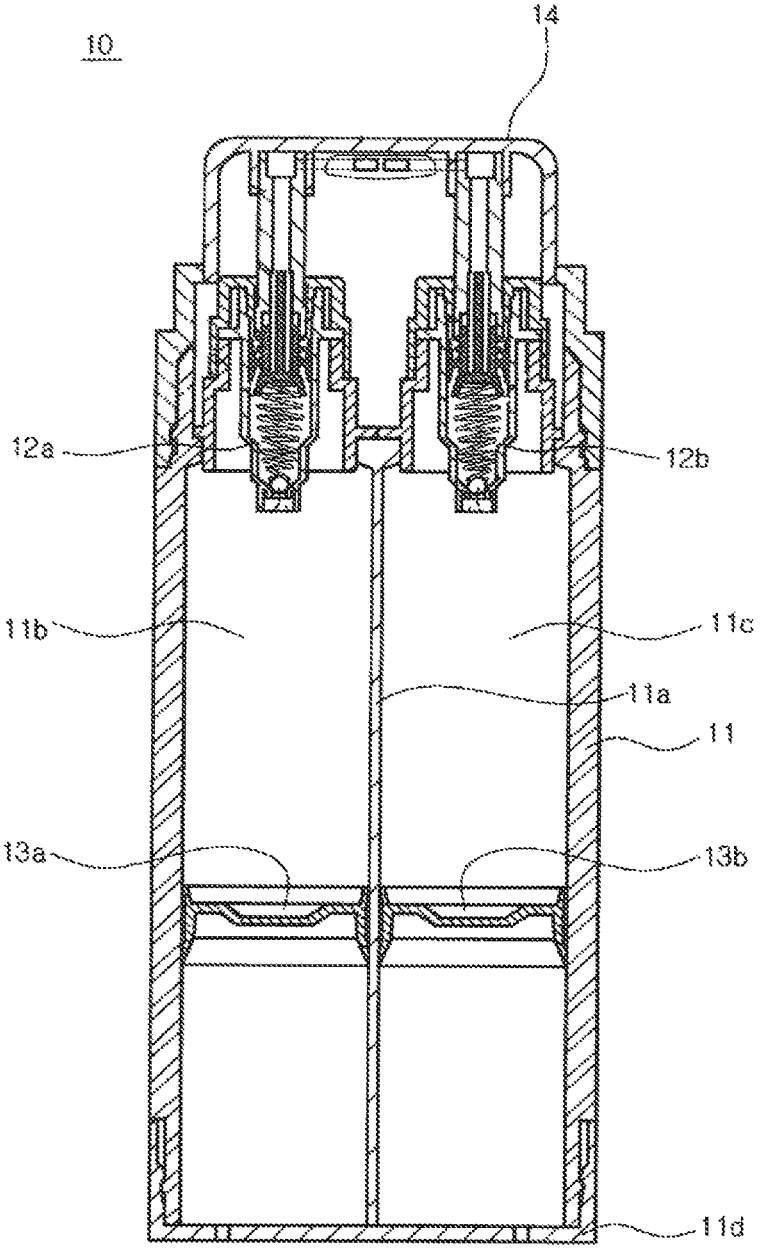
FIG. 1 is a sectional view showing the configuration of a heterogeneous content mixing cosmetic container according to the related art.
Figure 2:
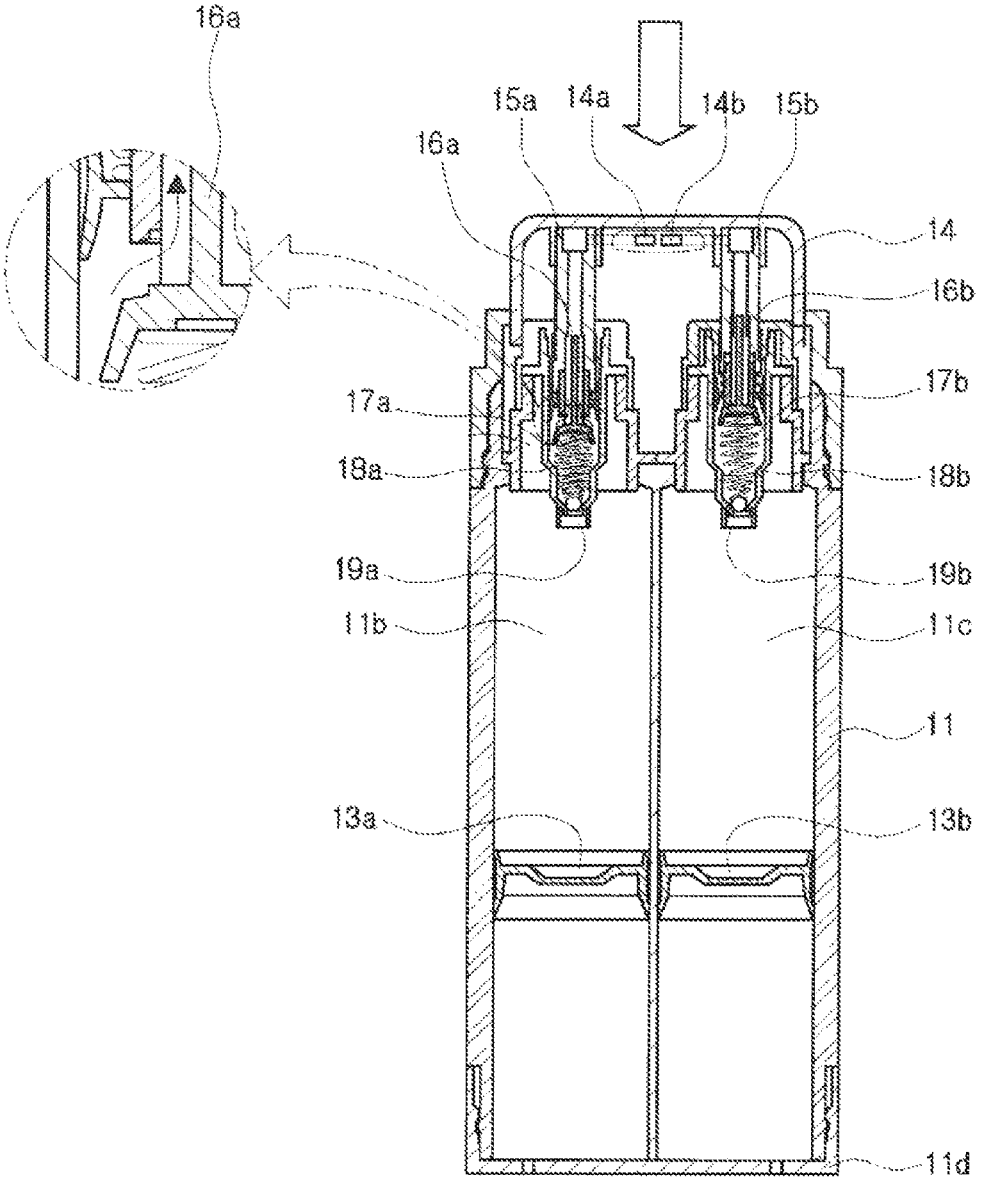
FIG. 2 is a use-state sectional view showing the operation of the heterogeneous content mixing cosmetic container according to the related art.
Figure 3:
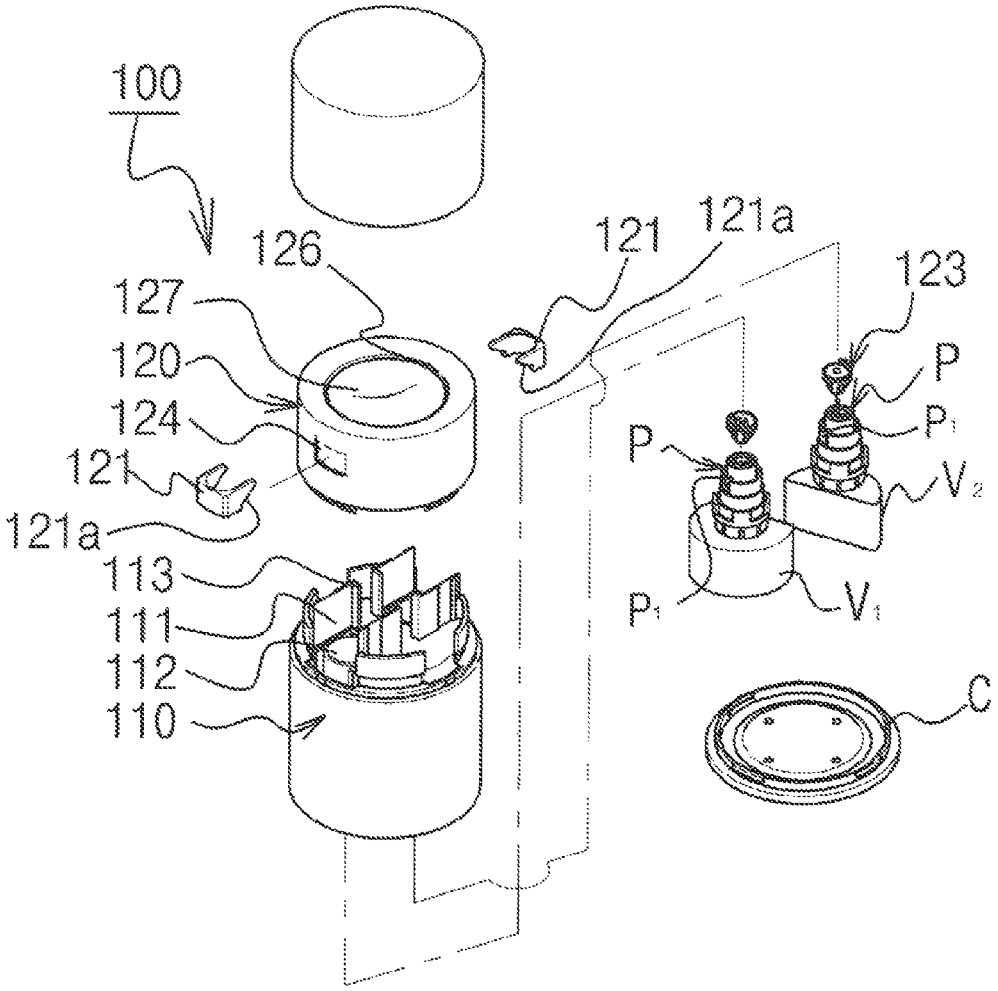
FIG. 3 is an exploded perspective view showing a cosmetic container according to the present invention.
Figure 4:
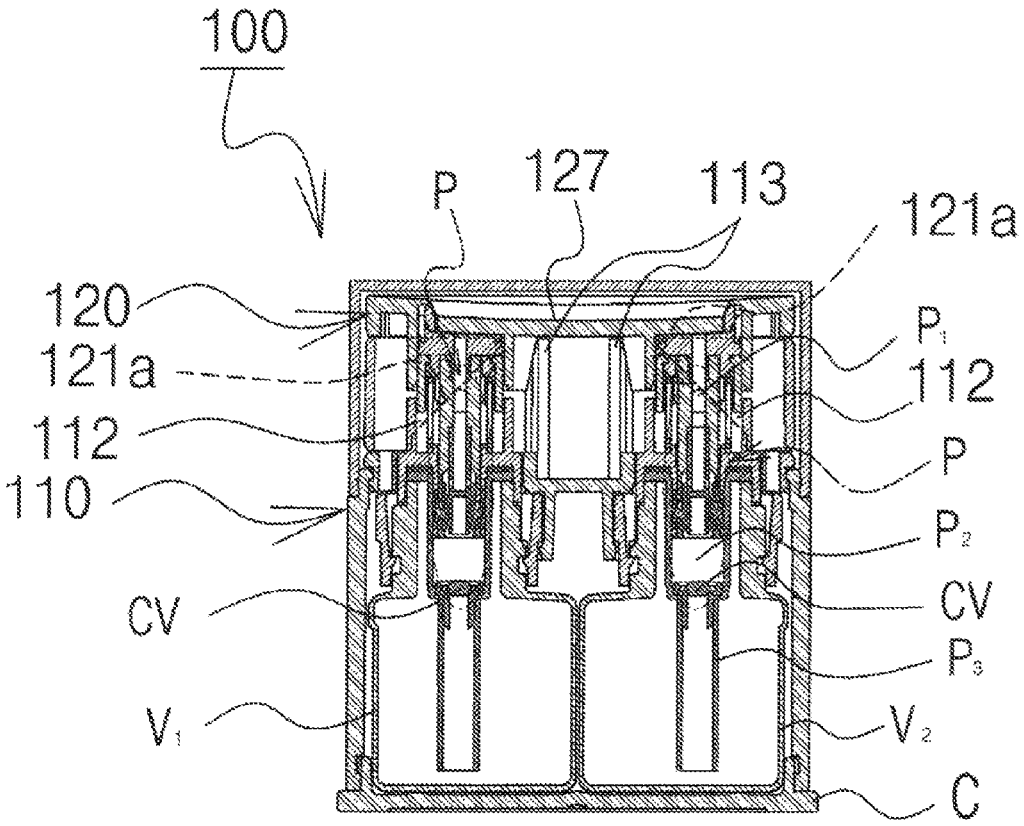
FIG. 4 is a sectional view showing the entire portion of the cosmetic container according to the present invention.
Figure 5:
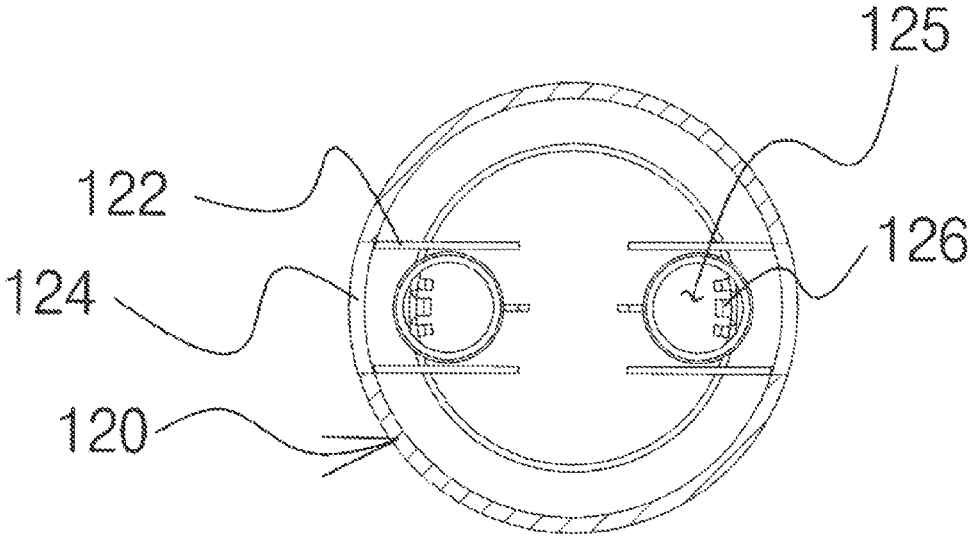
FIG. 5 is a partially sectional bottom view showing a portion of a content discharging housing according to the present invention.
Figure 6:
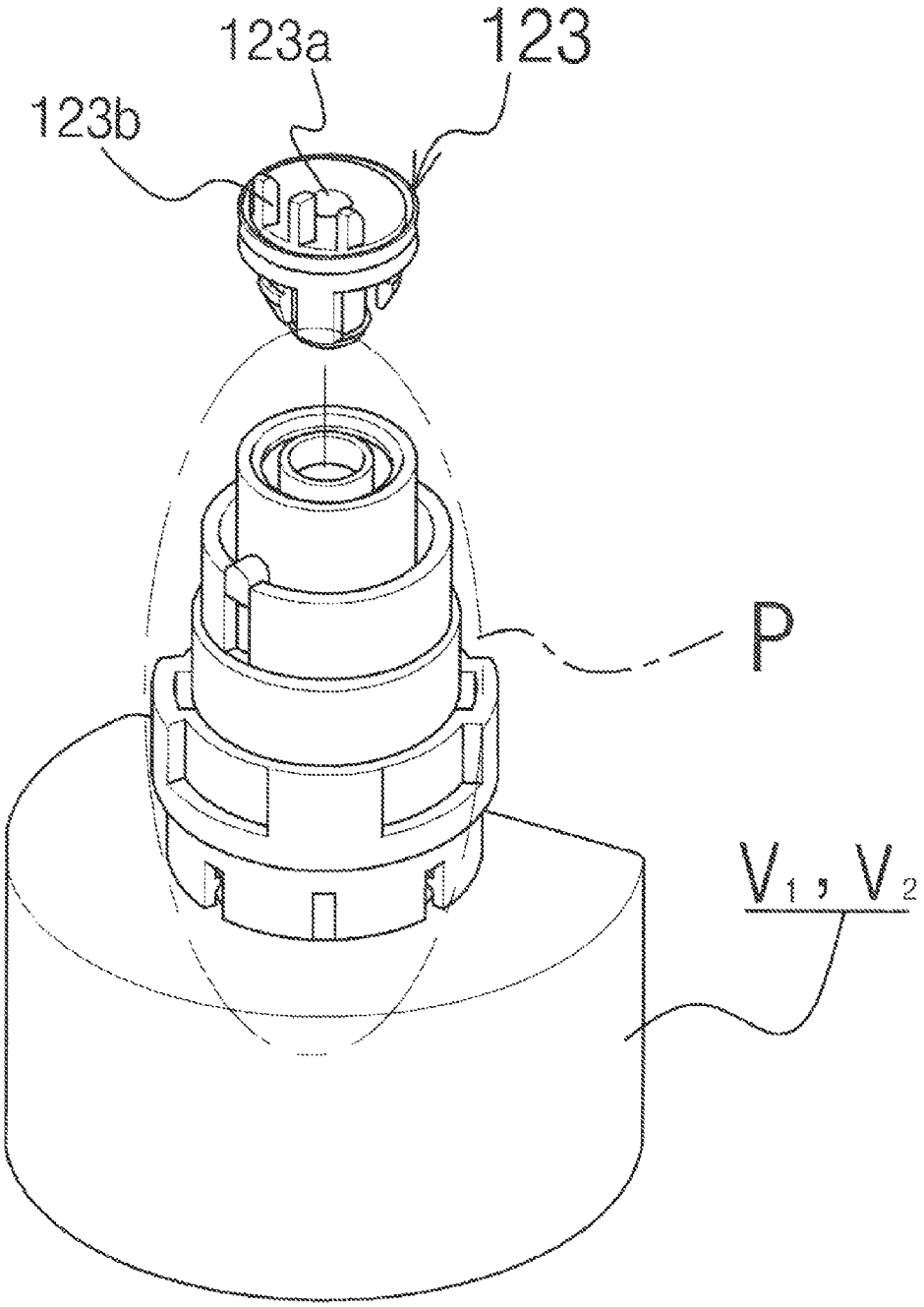
FIG. 6 is an exploded perspective view showing a content discharge piston and a piston according to the present invention.

Hereinafter, the present invention will be described in detail with reference to accompanying drawings.

As shown in FIGS. 3 to 6, the present invention provides a cosmetic container 100 including first and second storage containers $V_1$ and $V_2$ to receive cosmetic contents, pistons P provided at openings of the first and second storage containers $V_1$ and $V_2$, respectively, to discharge the cosmetic contents, and a container body 110 coupled to a lower cap C to receive the first and second storage containers $V_1$ and $V_2$.

In addition, a content discharging housing 120 is detachably mounted at an upper portion of the container body 110 to receive a side button 121. A lower guide 111 is provided at the upper portion of the container body 110 to guide the side button 121 when the side button 121 slides. The content discharging housing 120 is provided therein with an upper guide 122 to guide the side button 121 when the side button 121 slides.

A content discharge piston 123, which descends down as the side button 121 is pressed and ascends as the pressing of the side button 12 is released, is undercut-coupled to an upper end portion of the piston P as an inclined surface 121*a* of the side button 121 presses a pressing protrusion AP-1 protruding from an upper end portion of the piston P.

In addition, two lower guides 111 are grouped into one group and provided symmetrically to each other. A piston receiving groove 112 is defined in the space between both lower guides 111 to receive the piston P, and the lower guide 111 is provided at a distal end thereof with a stopper 113 to stop the side button 121.

In addition, the content discharging housing 120 is provided in a side surface thereof with a button receiving groove 124 to receive the side button 121. Two upper guides 122 are grouped into one group and provided symmetrically to each other. A discharge piston receiving groove 125 is defined in the space between both upper guides 122 to receive the content discharge piston 123. The content discharge piston 123 has a discharge hole 123*a* formed in a hollow structure to discharge the cosmetic contents and an opening/closing protrusion 123*b* provided at an upper end portion thereof. The discharge piston receiving groove 125 is provided at an upper end portion thereof with an outlet 126 to discharge the cosmetic content, and the content discharging housing 120 is provided at an upper portion thereof with an arc surface 127 recessed in a dish shape to gather the discharged cosmetic contents to the center. The outlet 126 of the discharge piston receiving groove 125 is formed in the side of the arc surface 127.

In this case, the opening/closing protrusion 123*b* may open/close the outlet 126.

Hereinafter, the operation of the present invention having the above configuration will be described.

Figure 7A:
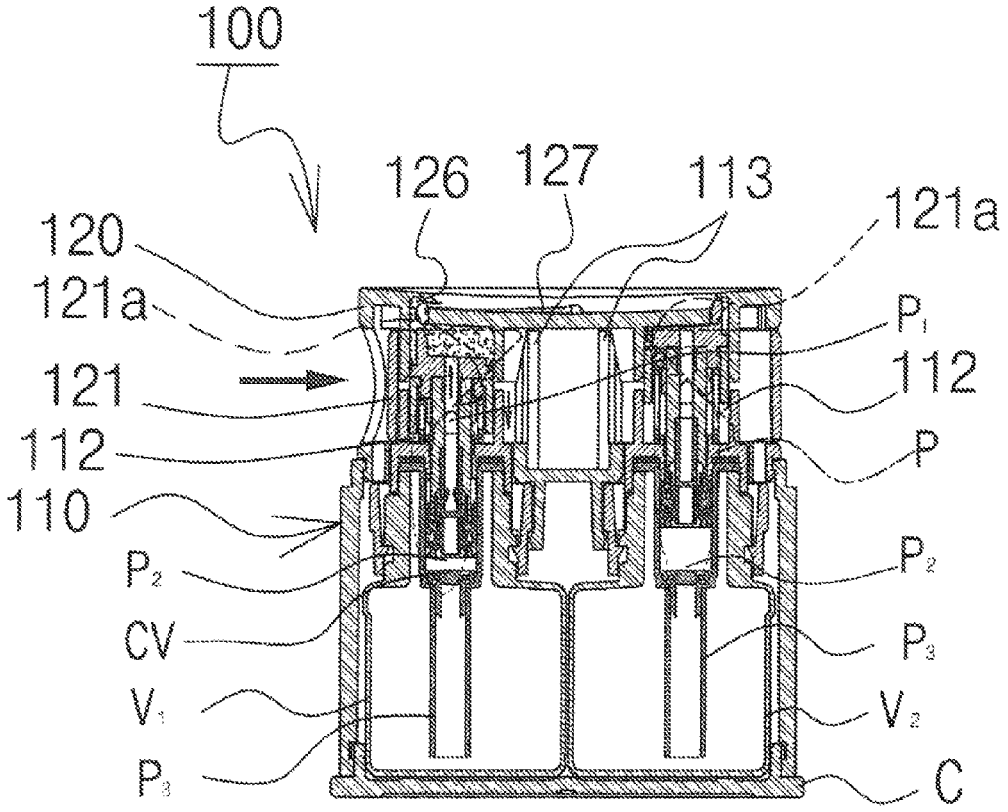
FIGS. 7*a* to 7*b* are sectional views showing the operating state according to the present invention.

When one of the first and second storage containers is selected for use and when an upper cap is separated from the container body 110 and the side button 121 provided at one side of the container body 110 is pressed to slide into the content discharging housing 120 as shown in FIG. 7*a*, the side button 121 slides along the guides of the upper and lower guides 122 and 111 and the inclined surface 121*a* formed at the lower portion of the side button 121 presses down the the pressing protrusion P, protruding from the upper portion of the piston P.

Accordingly, the content discharge piston 123 coupled to the piston P descends. In this case, a passage to transfer contents in the piston P is open, so that the cosmetic contents stored in a temporary storage chamber $P_2$ are discharged through the discharge hole 123*a*.

Thereafter, if the force to press the side button 121 is released, the piston P and the content discharge piston 123 ascend by the spring in the piston P while the pressing protrusion $P_1$ pushes the inclined surface 121*a* of the side button 121. Accordingly, the side button 121 returns to the original position thereof while the opening/closing protrusion 123*b* of the content discharge piston 123 closes the outlet 126 of the content discharging housing 120.

Simultaneously, the piston rod in the piston P ascends while a piston packing closes the passage to transfer the contents. Accordingly, in the cylinder of the piston P, vacuum pressure is generated to open a check valve CV while the cosmetic contents stored in the first storage container $V_1$ ascends through a suction valve tube $P_3$.

Figure 7B:
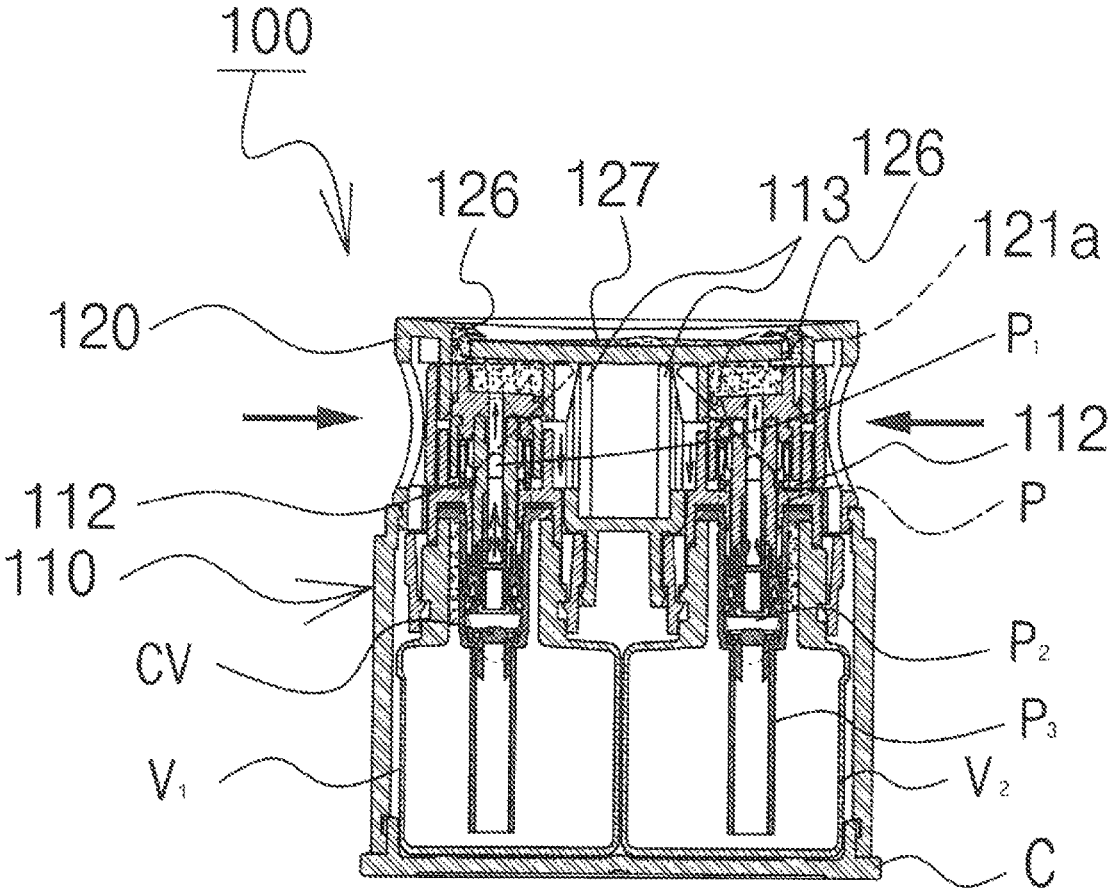

The content discharge piston 123 descends or ascends together with the piston P. When the content discharge piston 123 descends, the opening/closing protrusion 123*b* protruding from the upper portion of the content discharge piston 123 descends together to be separated from the outlet 126 of the content discharging housing 120. Accordingly, the outlet 126 is open so that the cosmetic contents are discharged and gathered to the arc surface 127 formed at the upper portion of the content discharging housing Meanwhile, when both of two kinds of cosmetic contents stored in the first and second storage containers $V_1$ and $V_2$ are simultaneously discharged and mixed for use, as both side buttons 121 are simultaneously pressed as shown in FIG. 7*b*, the side buttons 121 and the content discharge piston 123 perform the following operations.

In other words, when the two kinds of cosmetic contents are simultaneously discharged, as the outlet 126 of the content discharging housing 120 is formed in the side of the arc surface 127 recessed in a dish shape, and a pair of outlets 126 are formed while facing each other, the two kinds of cosmetic contents are discharged through the outlets 126 while being gathered to the center of the are surface 127, so that the cosmetic contents may be mixed and used.

After the cosmetic contents are discharged and used as described above, the content discharge piston 123 ascends as described above, so that the opening/closing protrusion 123*b* closes the outlet 126 of the content discharging housing 120 to prevent the cosmetic contents remaining in the outlet 126 and the piston P from being dried or contaminated by the external air.

In addition, after the cosmetic contents in the cosmetic container according to the present invention are used up, if the first and second storage containers V1 and V2 are replaced with new containers, the cosmetic container according to the present invention may be reused. Regarding the refill of the first and second storage containers $V_1$ and $V_2$ if the side button 121 is pressed after a lower cap C is separated from the container body 110, the inclined surface 121*a* of the side button 121 moves down the pressing protrusion P1 of the piston P. In this case, since the lower cap C is removed from the lower portion of the container body 110, as the pressing protrusion P1 descends, the first and second storage containers $V_1$ and $V_2$ are pressed down and separated from the container body 110.

If the old first and second storage containers $V_1$ and $V_2$ are removed, new first and second storage containers $V_1$ and $V_2$ are pushed inward from the lower portion of the container body 110 and fitted around the pistons P.

Thereafter, if the lower cap C is coupled to the lower portion of the container body 110, the refill is completed.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

REFERENCE SIGN LIST $V_1$: first storage containers, $V_2$: second storage containers
P: pistons, C: lower cap
$P_1$, pressing protrusion, 100: cosmetic container
110: container body, 111: lower guides
112: piston receiving groove, 113: stopper
120: content discharging housing, 121: side button
121*a*: inclined surface, 122: upper guide
123: content discharge piston, 123*a*: discharge hole
123*b*: opening/closing protrusion
124: button receiving groove
125: discharge piston receiving groove
126: outlet
127: arc surface

The invention claimed is:

1. A cosmetic container for storing and discharging two kinds of cosmetics, the cosmetic container comprising:

first and second storage containers (V1 and V2) to receive cosmetic contents;

pistons (P) provided in openings of the first and second storage containers (V1 and V2) to discharge the cosmetic contents;

a container body (10) coupled to a lower cap (C) to receive the first and second storage containers (V1 and V2);

a content discharging housing (120) coupled to an upper portion of the container body (110) and formed therein with a button receiving groove (124) to receive a side button (121);

the side button (121) received in the button receiving groove (124) of the content discharging housing (120) to move back and forth; and a content discharge piston (123) descending down as the side button (121) is pressed, and ascending as the pressing of the side button (121) is released, wherein the container body (110) is provided at an upper portion thereof with a piston receiving groove (112), lower guides (111) are formed at left and right sides of the piston receiving groove (112) to guide the side button (121) to move back and forth, the content discharging housing (120) is formed therein with a discharge piston receiving groove (125) to receive the content discharge piston (123) and formed at an upper portion thereof with an arc surface (127) having a dish shape, such that an upper most portion of the discharge piston receiving groove (125) and a side of the arc surface (127) are bored to form an outlet (126) to discharge the cosmetic contents, and the content discharge piston (123) is formed at a center thereof with a discharge hole (123*a*) to discharge the cosmetic contents, and formed at an upper end portions thereof with an opening/closing protrusion (123*b*).

2. The cosmetic container of claim 1, wherein the content discharging housing (120) has an upper guide (122) to guide the side button (121) to a left side or a right side of the discharge piston receiving groove (125).

3. The cosmetic container of claim 2, wherein the outlet (126) is formed by a pair of outlets (126) facing each other such that two kinds of cosmetic contents which are discharged are gathered to a center of the arc surface (127).

4. The cosmetic container of claim 1, wherein the lower guide (111) is provided at a distal end thereof with a stopper (113) to stop the side button (121).

5. The cosmetic container of claim 1, wherein the outlet (126) is formed by a pair of outlets (126) facing each other such that two kinds of cosmetic contents which are discharged are gathered to a center of the arc surface (127).

6. The cosmetic container of claim 1, wherein, in the content discharge piston (123), the opening/closing protrusion (123*b*) descends to be separated from the outlet (126) of the content discharging housing (120), and ascends to close the outlet (126) to prevent the cosmetic contents remaining in the outlet (126) from being dried or contaminated.

7. The cosmetic container of claim 1, wherein, after the lower cap (C) is removed from the container body (110), as the side button (121) is pressed, the first and second storage containers (V1 and V2) are pushed down to be removed, and replaced with new first and second storage containers (V1 and V2) to be coupled, and the cap (C) is coupled to a lower portion of the container body (110), so that refill is performed.

* * * * *